US011249439B2

(12) United States Patent
Hawes

(10) Patent No.: US 11,249,439 B2
(45) **Date of Patent: *Feb. 15, 2022**

(54) DRIVE COUPLER FOR A REPLACEABLE UNIT OF AN ELECTROPHOTOGRAPHIC IMAGE FORMING DEVICE

(71) Applicant: LEXMARK INTERNATIONAL, INC., Lexington, KY (US)

(72) Inventor: Brian Lee Hawes, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/150,209

(22) Filed: Jan. 15, 2021

(65) Prior Publication Data

US 2021/0132541 A1 May 6, 2021

Related U.S. Application Data

(63) Continuation of application No. 16/732,906, filed on Jan. 2, 2020, now Pat. No. 10,935,924.

(60) Provisional application No. 62/872,280, filed on Jul. 10, 2019.

(51) Int. Cl.
*G03G 15/00* (2006.01)
*G03G 21/16* (2006.01)

(52) U.S. Cl.
CPC ..... *G03G 21/1647* (2013.01); *G03G 21/1661* (2013.01)

(58) Field of Classification Search
CPC ..... G03G 15/757; G03G 21/1647; G03G 21/1661; G03G 21/1857; G03G 21/186
USPC ..... 399/167
See application file for complete search history.

(56) References Cited

U.S. PATENT DOCUMENTS 6,397,029 B1 * 5/2002 Portig ..... G03G 15/757 399/167
6,725,004 B2 * 4/2004 Ahn et al. ..... G03G 15/757 399/167
6,768,890 B2 * 7/2004 Cho et al. ..... G03G 15/757 399/167
6,892,042 B2 * 5/2005 Jang et al. ..... G03G 15/757 399/167
7,236,722 B2 * 6/2007 Portig ..... G03G 21/1647 399/167

(Continued)

*Primary Examiner* — William J Royer
(74) *Attorney, Agent, or Firm* — Justin M. Tromp

(57) ABSTRACT

An interface drive coupler for a replaceable unit of an electrophotographic image forming device according to one example embodiment includes a first component and a second component coaxial with the first component along a rotational axis of the interface drive coupler. A force receiving portion is positioned on the first component and a force transmitting portion is positioned on the second component. One of the first component and the second component includes a male connector and the other of the first component and the second component includes a female connector that matably receives the male connector. Each of the male connector and the female connector includes a helical thread that extends circumferentially around the rotational axis of the interface drive coupler and that is angled in an operative rotational direction of the interface drive coupler in a direction from the force receiving portion toward the force transmitting portion.

4 Claims, 12 Drawing Sheets

(56) References Cited

U.S. PATENT DOCUMENTS

| | | | | |
|---|---|---|---|---|
| 8,064,800 | B2 * | 11/2011 | Carter et al. | F16D 1/0858 399/167 |
| 8,257,185 | B2 * | 9/2012 | Carter et al. | G03G 15/80 464/105 |
| 9,709,928 | B2 * | 7/2017 | Embry et al. | G03G 15/1615 |
| 9,829,855 | B2 * | 11/2017 | Leemhuis et al. | G03G 21/1647 |
| 10,935,924 | B2 * | 3/2021 | Hawes | G03G 21/1661 |

* cited by examiner

DRIVE COUPLER FOR A REPLACEABLE UNIT OF AN ELECTROPHOTOGRAPHIC IMAGE FORMING DEVICE

CROSS REFERENCES TO RELATED APPLICATIONS

This application is a continuation application of U.S. patent application Ser. No. 16/732,906, filed Jan. 2, 2020, entitled "Drive Coupler for a Replaceable Unit of an Electrophotographic Image Forming Device," which claims priority to U.S. Provisional Patent Application Ser. No. 62/872,280, filed Jul. 10, 2019, entitled "Drive Coupler for a Replaceable Unit of an Electrophotographic Image Forming Device," the contents of which are hereby incorporated by reference in their entirety.

BACKGROUND

1. Field of the Disclosure

The present disclosure relates generally to image forming devices and more particularly to a drive coupler for a replaceable unit of an electrophotographic image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

One or more replaceable units typically deliver toner to the image forming device for transfer to the print media. Each replaceable unit includes one or more drive couplers that mate with corresponding drive couplers in the image forming device to transfer rotational motion from one or more motors in the image forming device to rotatable components of the replaceable units. Each drive coupler must possess sufficient rigidity to effectively transfer rotational motion received from the corresponding drive coupler in the image forming device. However, it is also desired to minimize cost and manufacturing complexity of the drive coupler.

SUMMARY

A replaceable unit for use in an electrophotographic image forming device according to one example embodiment includes a housing and a rotatable component mounted on the housing. A drive coupler is mounted on the housing and is rotatable about a rotational axis. The drive coupler of the replaceable unit has a force receiving portion exposed on the housing to contact and receive rotational force from a corresponding drive coupler in the image forming device when the replaceable unit is installed in the image forming device. The drive coupler of the replaceable unit has a force transmitting portion operatively connected to the rotatable component for transferring rotational force received by the force receiving portion from the corresponding drive coupler in the image forming device to the rotatable component. The drive coupler of the replaceable unit includes a first component and a second component that is coaxial with the first component. The force receiving portion is positioned on the first component and the force transmitting portion is positioned on the second component. One of the first and second components includes a plurality of ribs that are spaced circumferentially around the rotational axis of the drive coupler of the replaceable unit and that are angled in an operative rotational direction of the drive coupler of the replaceable unit in a direction from the force receiving portion toward the force transmitting portion along the rotational axis of the drive coupler of the replaceable unit. The other of the first and second components includes a plurality of grooves that are spaced circumferentially around the rotational axis of the drive coupler of the replaceable unit and that are correspondingly angled in the operative rotational direction of the drive coupler of the replaceable unit in the direction from the force receiving portion toward the force transmitting portion along the rotational axis of the drive coupler of the replaceable unit. The plurality of grooves matably receive the plurality of ribs.

An interface drive coupler for a replaceable unit of an electrophotographic image forming device according to one example embodiment includes a first component and a second component coaxial with the first component along a rotational axis of the interface drive coupler. A force receiving portion is positioned on the first component for receiving rotational force from a corresponding drive coupler in the image forming device. A force transmitting portion is positioned on the second component for transferring rotational force received by the force receiving portion to a rotatable component of the replaceable unit. One of the first and second components includes a plurality of ribs that are spaced circumferentially around the rotational axis of the interface drive coupler and that are angled in an operative rotational direction of the interface drive coupler in a direction from the force receiving portion toward the force transmitting portion along the rotational axis of the interface drive coupler. The other of the first and second components includes a plurality of grooves that are spaced circumferentially around the rotational axis of the interface drive coupler and that are correspondingly angled in the operative rotational direction of the interface drive coupler in the direction from the force receiving portion toward the force transmitting portion along the rotational axis of the interface drive coupler. The plurality of grooves matably receive the plurality of ribs to prevent the first and second components from separating from each other.

A replaceable unit for use in an electrophotographic image forming device according to another example embodiment includes a housing and a rotatable component mounted on the housing. A drive coupler is mounted on the housing and is rotatable about a rotational axis. The drive coupler of the replaceable unit has a force receiving portion exposed on the housing to contact and receive rotational force from a corresponding drive coupler in the image forming device when the replaceable unit is installed in the image forming device. The drive coupler of the replaceable unit has a force transmitting portion operatively connected to the rotatable component for transferring rotational force received by the force receiving portion from the corresponding drive coupler in the image forming device to the rotatable component. The drive coupler of the replaceable unit includes a first component and a second component that is coaxial with the first component. The force receiving portion is positioned on the first component and the force transmitting portion is positioned on the second component. One of the first component and the second component includes a male connector and the other of the first component and the second component includes a female connector that matably receives the male connector. Each of the male connector and the female connector includes a helical thread that extends circumferentially around the rotational axis of the drive coupler of the replaceable unit and that is angled in an operative rotational direction of the drive coupler of the replaceable unit in a direction from the force receiving portion toward the force transmitting portion along the rotational axis of the drive coupler of the replaceable unit. The helical thread of the male connector is engaged with the helical thread of the female connector joining the first component to the second component.

BRIEF DESCRIPTION OF THE DRAWINGS

The accompanying drawings incorporated in and forming a part of the specification illustrate several aspects of the present disclosure and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
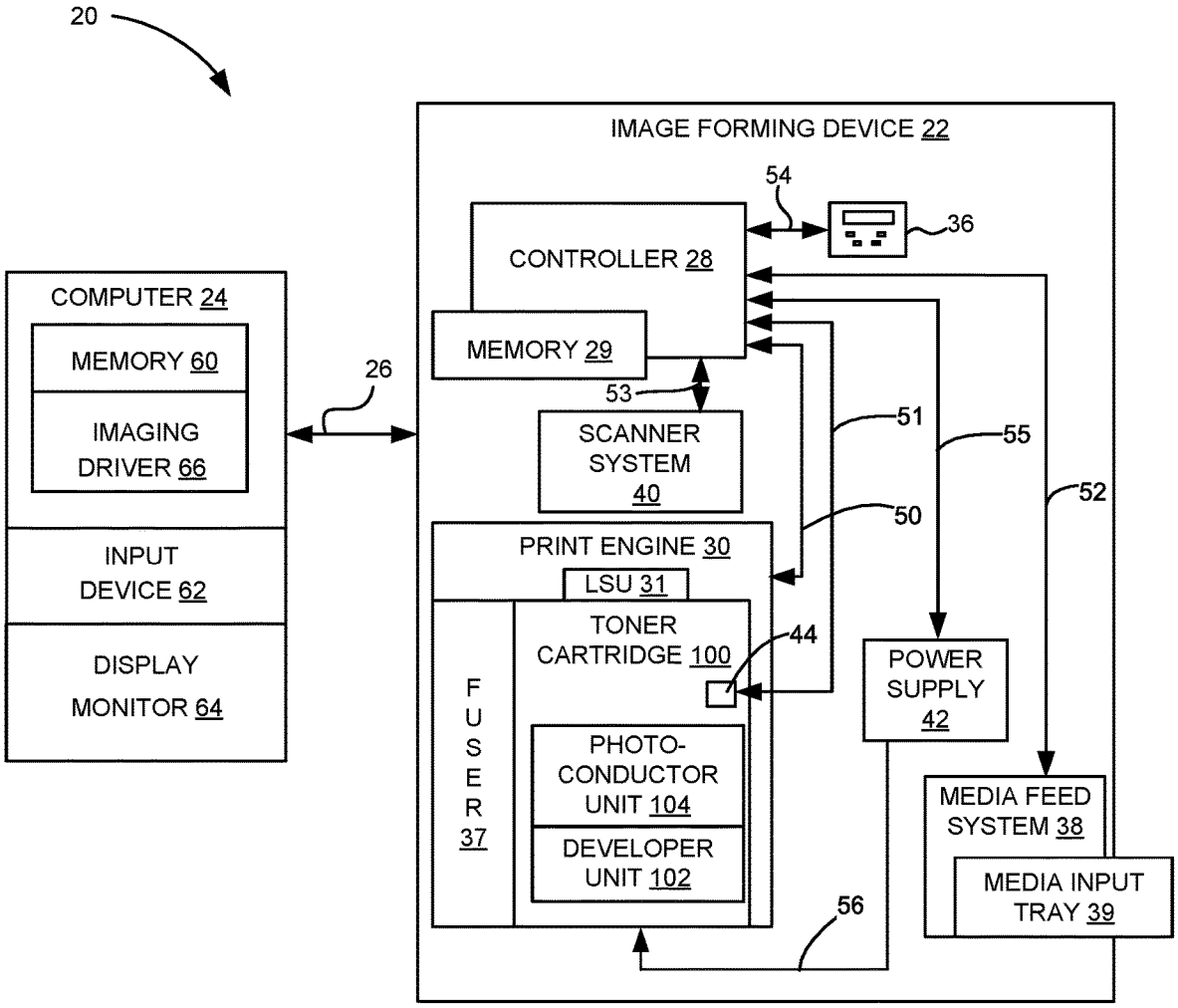
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, a toner cartridge 100, a user interface 36, a media feed system 38, a media input tray 39, a scanner system 40 and a power supply 42. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated electronic memory 29. The processor unit may include one or more integrated circuits in the form of a microprocessor or central processing unit and may include one or more Application-Specific Integrated Circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with toner cartridge 100 and processing circuitry 44 thereon via a communications link 51. Controller 28 communicates with media feed system 38 via a communications link 52. Controller 28 communicates with scanner system 40 via a communications link 53. User interface 36 is communicatively coupled to controller 28 via a communications link 54. Controller 28 communicates with power supply 42 via a communications link 55. Controller 28 processes print and scan data and operates print engine 30 during printing and scanner system 40 during scanning. Processing circuitry 44 may provide authentication functions, safety and operational interlocks, operating parameters and usage information related to toner cartridge 100. Processing circuitry 44 includes a processor unit and associated electronic memory. As discussed above, the processor may include one or more integrated circuits in the form of a microprocessor or central processing unit and/or may include one or more Application-Specific Integrated Circuits (ASICs). The memory may be any volatile or non-volatile memory or combination thereof or any memory device convenient for use with processing circuitry 44.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes the laser scan unit (LSU) 31, toner cartridge 100 and a fuser 37, all mounted within image forming device 22. Toner cartridge 100 is removably mounted in image forming device 22. Power supply 42 provides an electrical voltage to various components of toner cartridge 100 via an electrical path 56. Toner cartridge 100 includes a developer unit 102 that houses a toner reservoir and a toner development system. In the example embodiment illustrated, the toner development system utilizes what is commonly referred to as a single component development system. In this embodiment, the toner development system includes a toner adder roll that provides toner from the toner reservoir to a developer roll. A doctor blade provides a metered, uniform layer of toner on the surface of the developer roll. Toner cartridge 100 also includes a photoconductor unit 104 that houses a charge roll, a photoconductive drum and a waste toner removal system. Although the example image forming device 22 illustrated in FIG. 1 includes one toner cartridge, in the case of an image forming device configured to print in color, separate toner cartridges may be used for each toner color. For example, in one embodiment, the image forming device includes four toner cartridges, each toner cartridge containing a particular toner color (e.g., black, cyan, yellow and magenta) to permit color printing.

Figure 2:
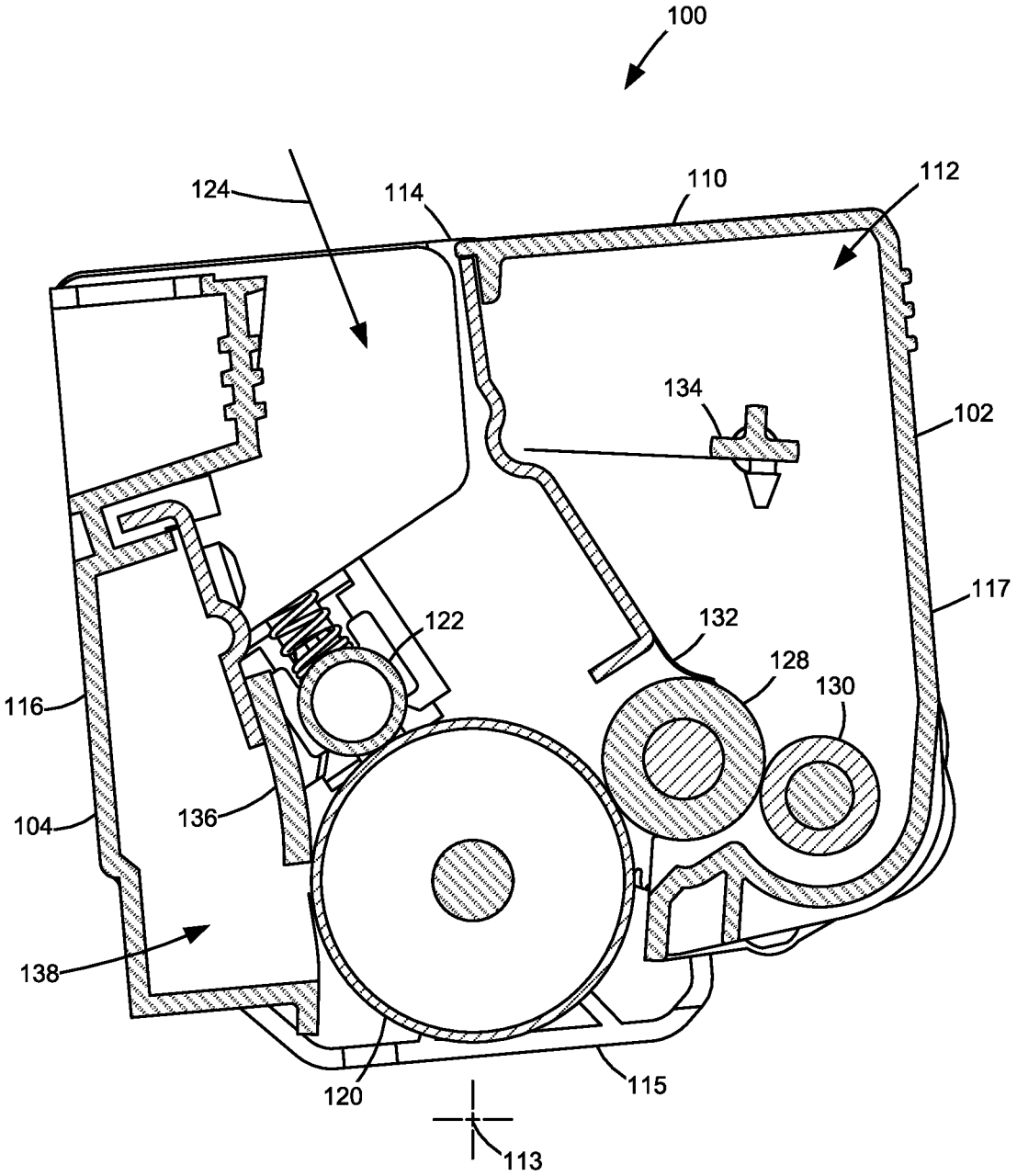
FIG. 2 is a cross-sectional view of a toner cartridge of the imaging system according to one example embodiment.

FIG. 2 shows toner cartridge 100 according to one example embodiment. Toner cartridge 100 includes an elongated housing 110 that includes walls forming a toner reservoir 112. In the example embodiment illustrated, housing 110 extends along a longitudinal dimension 113 and includes a top 114, a bottom 115, a side 116 and a side 117 that extend between longitudinal ends 118, 119 (FIGS. 3 and 4) of housing 110. In this embodiment, developer unit 102 is positioned along side 117 of housing 110 and photoconductor unit 104 is positioned along side 116 of housing 110.

The electrophotographic printing process is well known in the art and, therefore, is described briefly herein. During a print operation, a rotatable charge roll 122 of photoconductor unit 104 charges the surface of a rotatable photoconductive drum 120. The charged surface of photoconductive drum 120 is then selectively exposed to a laser light source 124 from LSU 31 through a slit 126 (FIG. 4) in the top 114 of housing 110 to form an electrostatic latent image on photoconductive drum 120 corresponding to the image to be printed. Charged toner from developer unit 102 is picked up by the latent image on photoconductive drum 120 creating a toned image on the surface of photoconductive drum 120. Charge roll 122 and photoconductive drum 120 are each electrically charged to a respective predetermined voltage by power supply 42 in order to achieve a desired voltage differential between the charged portions of the surface of photoconductive drum 120 and the portions of the surface of photoconductive drum 120 discharged by laser light source 124.

Developer unit 102 includes toner reservoir 112 having toner stored therein and a rotatable developer roll 128 that supplies toner from toner reservoir 112 to photoconductive drum 120. In the example embodiment illustrated, a rotatable toner adder roll 130 in developer unit 102 supplies toner from toner reservoir 112 to developer roll 128. A doctor blade 132 disposed along developer roll 128 provides a substantially uniform layer of toner on developer roll 128 for transfer to photoconductive drum 120. As developer roll 128 and photoconductive drum 120 rotate, toner particles are electrostatically transferred from developer roll 128 to the latent image on photoconductive drum 120 forming a toned image on the surface of photoconductive drum 120. In one embodiment, developer roll 128 and photoconductive drum 120 rotate in opposite rotational directions such that their adjacent surfaces move in the same direction to facilitate the transfer of toner from developer roll 128 to photoconductive drum 120. One or more movable toner agitators 134 may be provided in toner reservoir 112 to distribute the toner therein and to break up any clumped toner. Developer roll 128 and toner adder roll 130 are each electrically charged to a respective predetermined voltage by power supply 42 in order to attract toner from toner reservoir 112 to toner adder roll 130 and to electrostatically transfer toner from toner adder roll 130 to developer roll 128 and from developer roll 128 to the latent image on the surface of photoconductive drum 120. Doctor blade 132 may also be electrically charged to a predetermined voltage by power supply 42 as desired.

The toned image is then transferred from photoconductive drum 120 to the print media (e.g., paper) either directly by photoconductive drum 120 or indirectly by an intermediate transfer member. In the example embodiment illustrated, the surface of photoconductive drum 120 is exposed from housing 110 along the bottom 115 of housing 110 where the toned image transfers from photoconductive drum 120 to the print media or intermediate transfer member. Fuser 37 (FIG. 1) then fuses the toner to the print media. A cleaner blade 136 (or cleaner roll) of photoconductor unit 104 removes any residual toner adhering to photoconductive drum 120 after the toner is transferred from photoconductive drum 120 to the print media or intermediate transfer member. Waste toner from cleaner blade 136 may be held in a waste toner reservoir 138 in photoconductor unit 104 as illustrated or moved to a separate waste toner container. The cleaned surface of photoconductive drum 120 is then ready to be charged again and exposed to laser light source 124 to continue the printing cycle.

Figure 3:
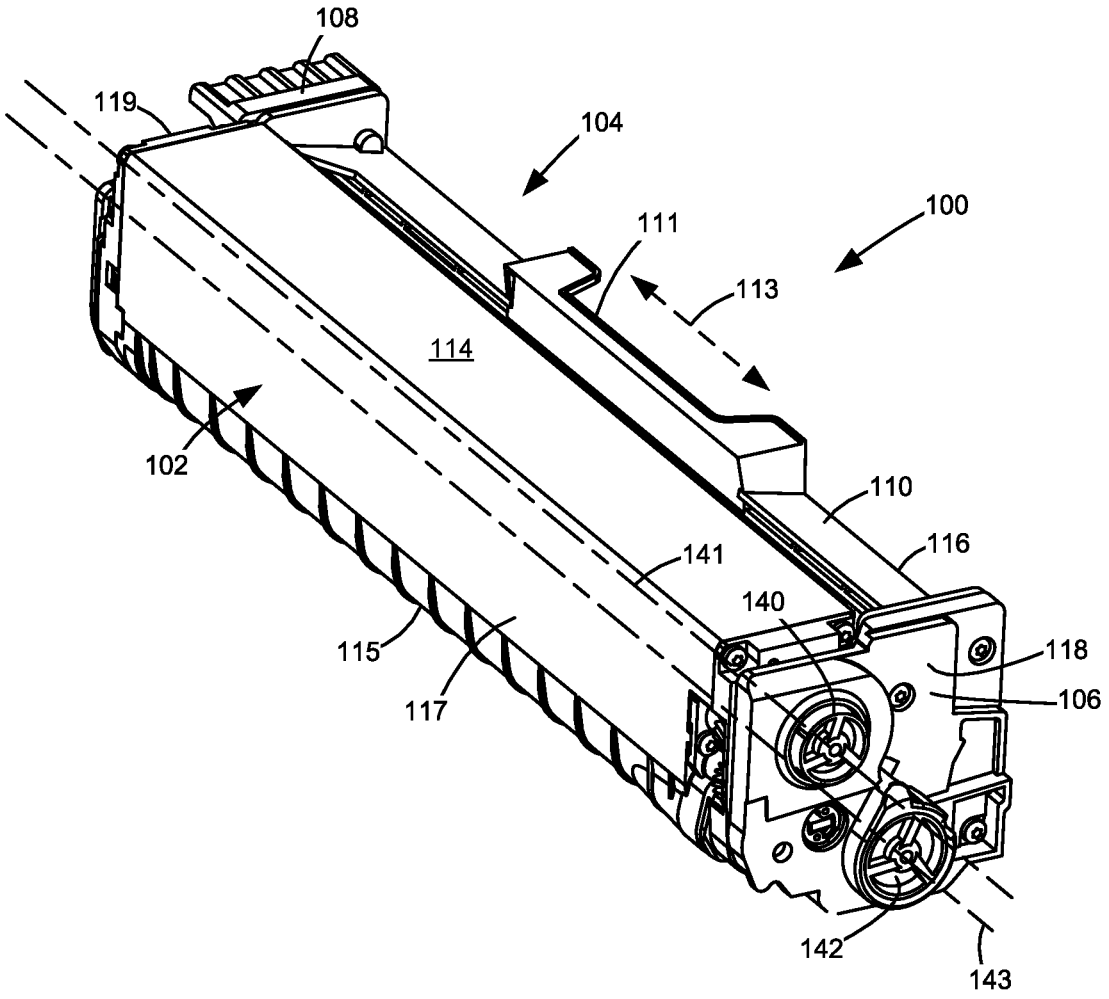
FIGS. 3 and 4 are perspective views of the toner cartridge according to one example embodiment.
Figure 4:
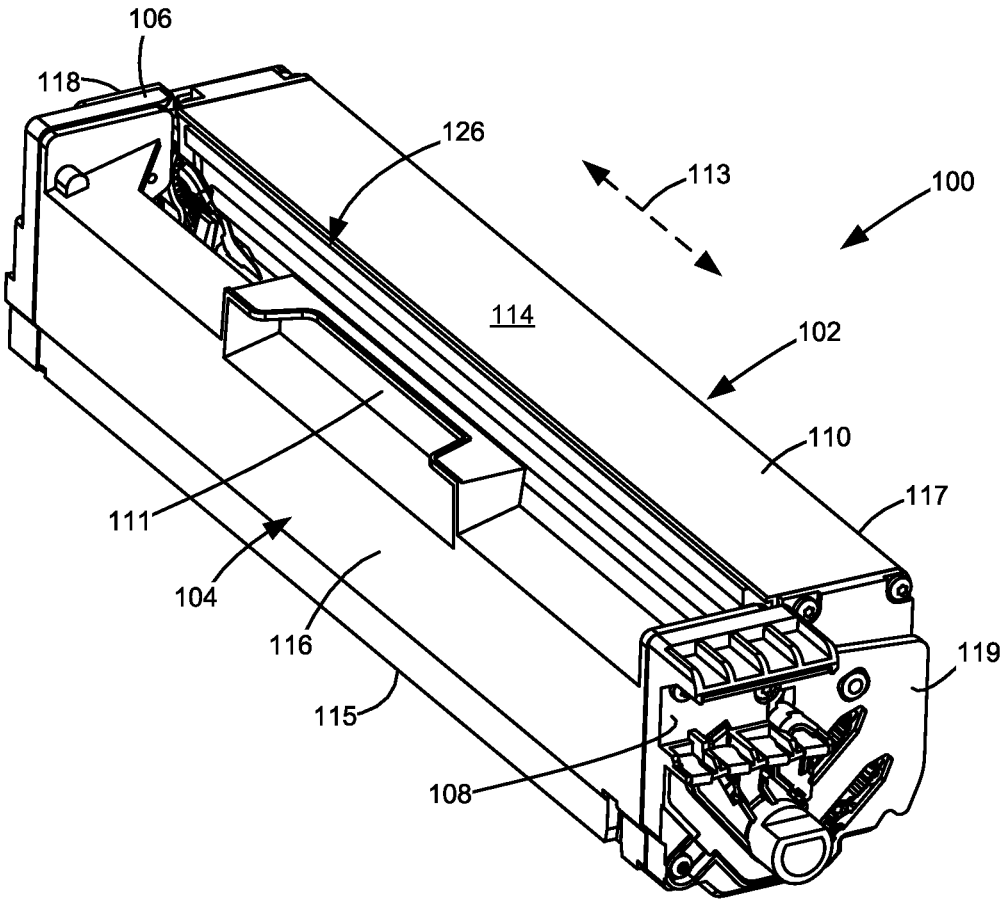
Figure 5:
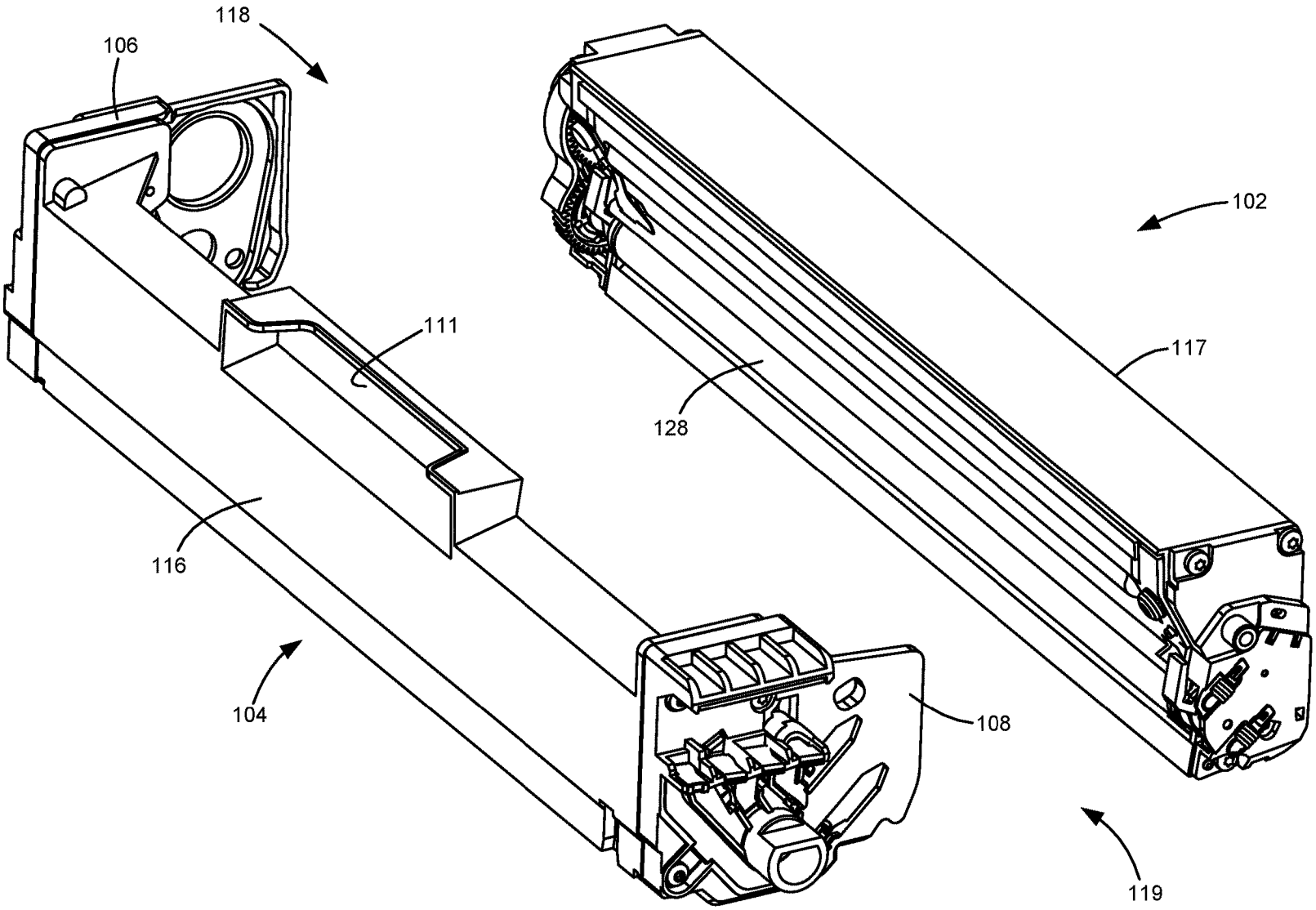
FIG. 5 is an exploded view of the toner cartridge shown in FIGS. 3 and 4 showing a developer unit and a photoconductor unit of the toner cartridge according to one example embodiment.

FIGS. 3-5 show the exterior of toner cartridge 100 according to one example embodiment. As shown, in this embodiment, developer unit 102 is positioned at side 117 of housing 110 and photoconductor unit 104 is positioned at side 116 of housing 110. FIG. 5 shows developer unit 102 separated from photoconductor unit 104 with developer roll 128 exposed on developer unit 102 for mating with photoconductive drum 120. In the example embodiment illustrated, toner cartridge 100 includes a handle 111 positioned along side 116 and/or top 114 of housing 110 to assist the user with handling toner cartridge 100.

Figure 6:
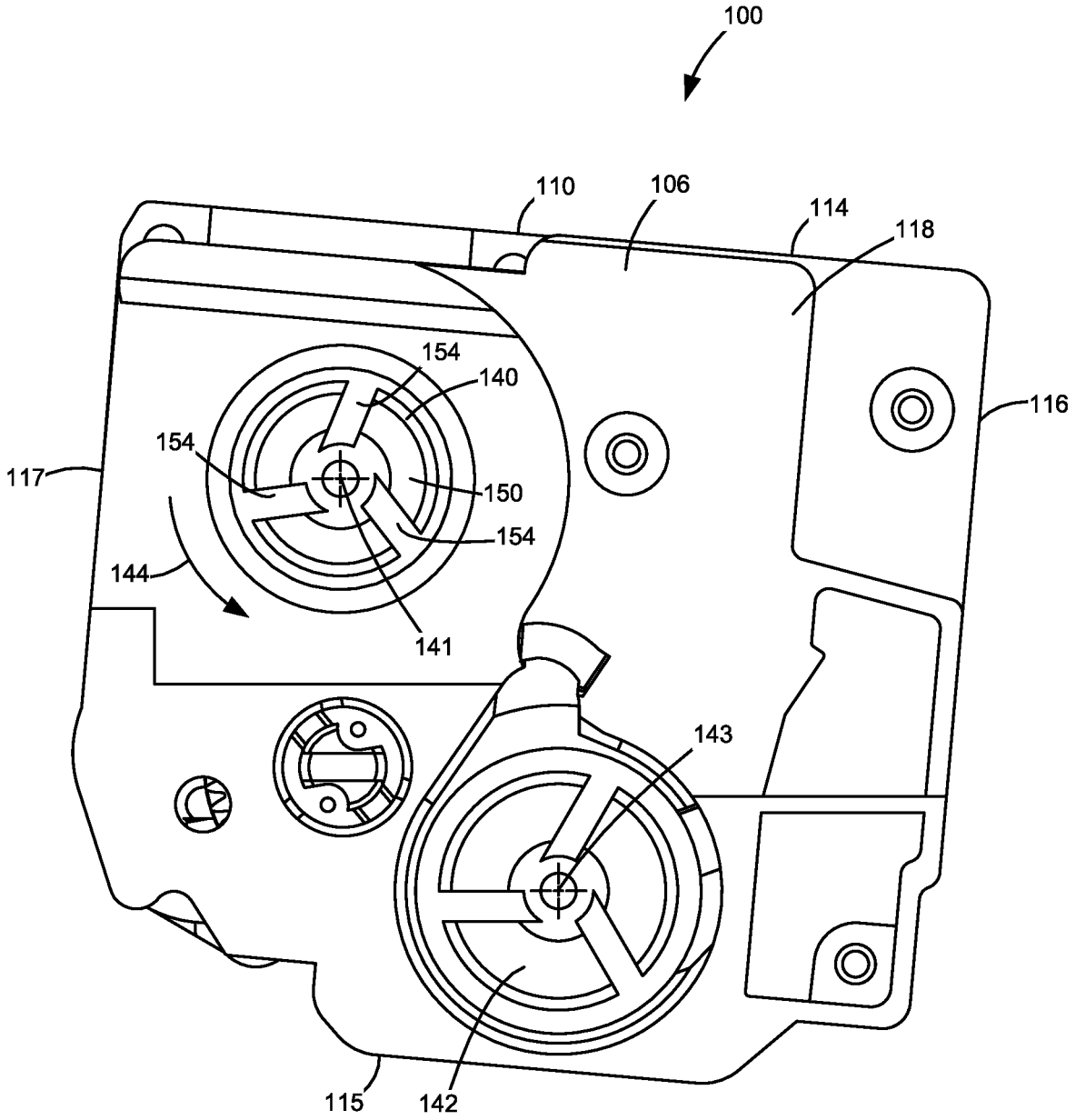
FIG. 6 is an elevation view of a first longitudinal end of the toner cartridge of FIGS. 3-5 according to one example embodiment.

With reference to FIGS. 3 and 6, in the example embodiment illustrated, a pair of interface drive couplers 140, 142 are exposed on an outer portion of housing 110 in position to receive rotational force from a corresponding drive system in image forming device 22 when toner cartridge 100 is installed in image forming device 22 to drive rotatable components of developer unit 102 and photoconductive drum 120, respectively. The drive system in image forming device 22 includes one or more drive motors and a drive transmission from the drive motor(s) to a pair of drive couplers that mate with drive couplers 140, 142 of toner cartridge 100 when toner cartridge 100 is installed in image forming device 22. In the example embodiment illustrated, drive couplers 140, 142 are each exposed on end 118 of housing 110. Each drive coupler 140, 142 includes a rotational axis 141, 143. In the example embodiment illustrated, drive couplers 140, 142 are each configured to mate with and receive rotational motion from the corresponding drive couplers in image forming device 22 at the axial ends of drive couplers 140, 142. Drive coupler 140 is operatively connected (either directly or indirectly through one or more intermediate gears) to rotatable components of developer unit 102 including, for example, developer roll 128, toner adder roll 130 and toner agitator 134, to rotate developer roll 128, toner adder roll 130 and toner agitator 134 upon receiving rotational force from the corresponding drive system in image forming device 22. Drive coupler 142 is operatively connected (either directly as in the embodiment illustrated or indirectly through one or more intermediate gears) to photoconductive drum 120 to rotate photoconductive drum 120 upon receiving rotational force from the corresponding drive system in image forming device 22. In some embodiments, charge roll 122 is driven by friction contact between the surfaces of charge roll 122 and photoconductive drum 120. In other embodiments, charge roll 122 is connected to drive coupler 142 by one or more gears.

Figure 7:
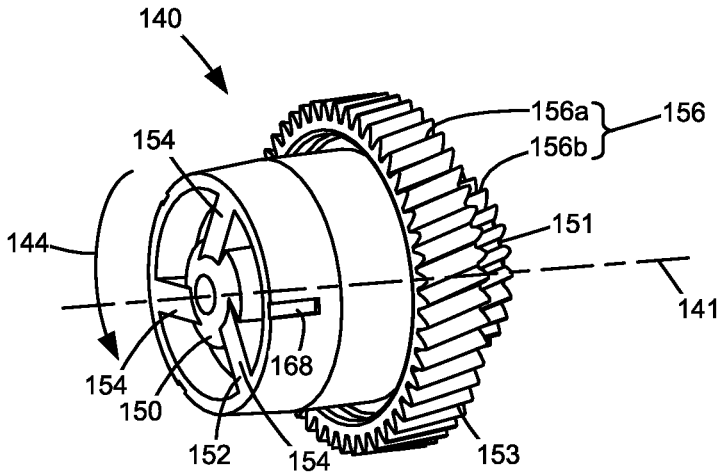
FIG. 7 is a perspective view of a drive coupler of the toner cartridge according to one example embodiment.

FIG. 7 shows drive coupler 140 in greater detail according to one example embodiment. Drive coupler 140 includes an outer axial end 150 that faces outward away from end 118 of housing 110 and an inner axial end 151 that faces inward toward opposite end 119 of housing 110 when drive coupler 140 is installed on housing 110. Drive coupler 140 includes a force receiving portion 152 and a force transmitting portion 153. In the embodiment illustrated, force receiving portion 152 is positioned proximate to outer axial end 150 and force transmitting portion 153 is positioned closer to inner axial end 151 than force receiving portion 152 is to inner axial end 151.

Force receiving portion 152 of drive coupler 140 contacts and receives rotational motion from the corresponding drive coupler in image forming device 22 when toner cartridge 100 is installed in image forming device 22 to rotate drive coupler 140 about rotational axis 141. In the embodiment illustrated, force receiving portion 152 of drive coupler 140 includes lugs 154 that are positioned on outer axial end 150 of drive coupler 140 and that are spaced circumferentially around rotational axis 141. In this embodiment, lugs 154 contact corresponding drive lugs on the corresponding drive coupler in image forming device 22 permitting the use of a corresponding drive coupler in image forming device 22 that is substantially coaxial with drive coupler 140. In other embodiments, force receiving portion 152 of drive coupler 140 includes gear teeth that mesh with and receive rotational force from corresponding gear teeth on the corresponding drive coupler in image forming device 22 when toner cartridge 100 is installed in image forming device 22.

Force transmitting portion 153 of drive coupler 140 contacts and transmits rotational motion received by force receiving portion 152 of drive coupler 140 to one or more gears of a drive train on housing 110 in order to rotate one or more rotatable components of developer unit 102. In some embodiments, force transmitting portion 153 of drive coupler 140 includes one or more sets of gear teeth 156 spaced axially inward from lugs 154 of force receiving portion 152. In the embodiment illustrated, force transmitting portion 153 of drive coupler 140 includes two sets of gear teeth 156*a*, 156*b* forming a compound gear suitable for simultaneously transmitting rotational motion to a pair of corresponding gears. In this embodiment, gear teeth 156*b* are positioned axially inward (i.e., closer to inner axial end 151) from gear teeth 156*a* and have a smaller diameter than gear teeth 156*a*; however, many configurations of gear teeth 156 are possible.

Figure 8:
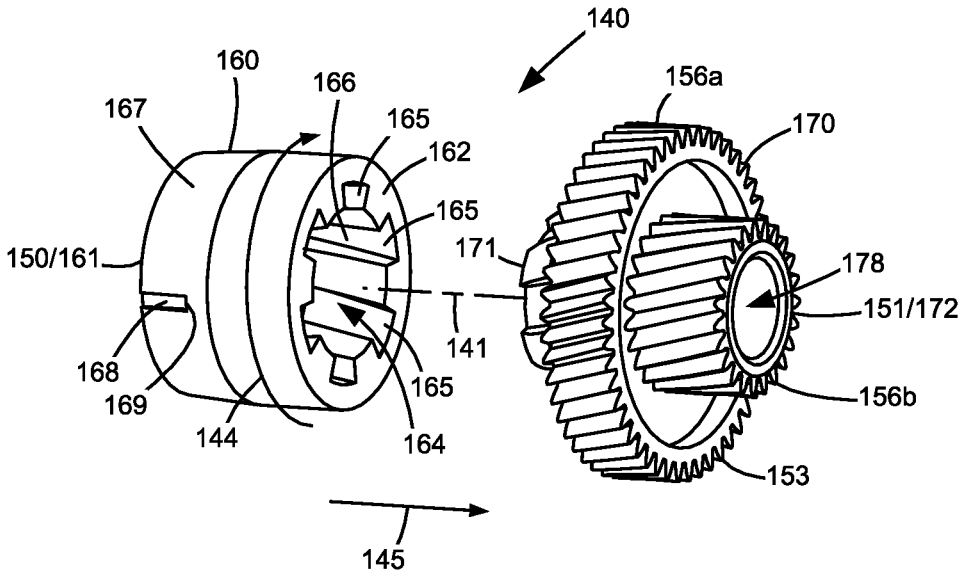
FIGS. 8 and 9 are exploded views of the drive coupler of FIG. 7 showing first and second components of the drive coupler according to one example embodiment.
Figure 9:
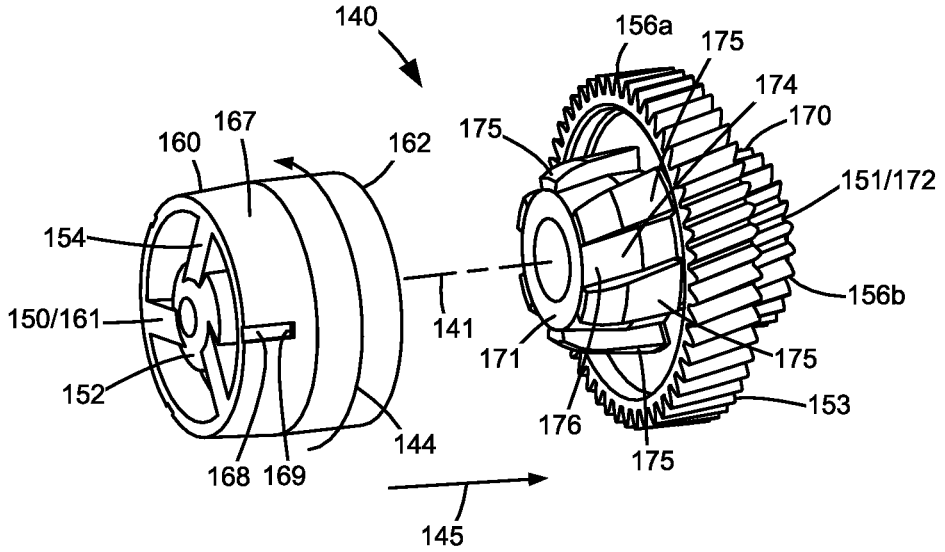

With reference to FIGS. 8 and 9, drive coupler 140 includes a first component 160 and a second component 170. Force receiving portion 152 is positioned on first component 160 and force transmitting portion 153 is positioned on second component 170. First and second components 160, 170 are separable from each other and, when joined, combine to form drive coupler 140. When first and second components 160, 170 are joined, first component 160 is positioned axially outward of second component 170 such that outer axial end 150 of drive coupler 140 is positioned on first component 160 and inner axial end 151 of drive coupler 140 is positioned on second component 170. Each of first and second components 160, 170 includes a respective outer axial end 161, 171 and a respective inner axial end 162, 172. Outer axial end 161 of first component 160 forms outer axial end 150 of drive coupler 140 and inner axial end 172 of second component 170 forms inner axial end 151 of drive coupler 140. In the example embodiment illustrated, first and second components 160, 170 are composed of molded plastic, such as, for example, polyoxymethylene (POM), including lubricated POMs.

First and second components 160, 170 are joined together by an angled press, e.g., a helical thread, at inner axial end 162 of first component 160 and outer axial end 171 of second component 170. In the embodiment illustrated, first component 160 includes an opening or slot 164 that extends axially into first component 160 from inner axial end 162 of first component 160 and that is centered about rotational axis 141 of drive coupler 140. In this embodiment, second component 170 includes a boss 174 that extends axially from outer axial end 171 of second component 170 and that is centered about rotational axis 141 of drive coupler 140. Slot 164 of first component 160 is sized to matably receive boss 174 of second component 170.

In the embodiment illustrated, first component 160 includes a series of grooves 165 positioned on an inner circumferential surface 166 of first component 160 that forms slot 164. Grooves 165 are spaced circumferentially from each other around rotational axis 141 of drive coupler 140. As shown in FIG. 8, grooves 165 are angled, e.g., helically, in an operative rotational direction 144 of drive coupler 140 in an axial direction 145 from outer axial end 161 toward inner axial end 162 of first component 160. In the embodiment illustrated, second component 170 includes a series of ribs 175 positioned on an outer circumferential surface 176 of boss 174 of second component 170. Ribs 175 are spaced circumferentially from each other around rotational axis 141 of drive coupler 140. As shown in FIG. 9, ribs 175 are angled, e.g., helically, in operative rotational direction 144 of drive coupler 140 in an axial direction 145 from outer axial end 171 toward inner axial end 172 of second component 170. Grooves 165 are positioned and sized to matably receive ribs 175 when first and second components 160, 170 are joined together. While the example embodiment illustrated includes first component 160 forming a female connector that includes slot 164 and grooves 165 and second component forming a male connector that includes boss 174 and ribs 175, this configuration may be reversed as desired to include a male connector on first component 160 and a female connector on second component 170. Further, while the example embodiment illustrated includes a female connector having a slot 164 with angled grooves 165 and a male connector having a boss 174 with angled ribs 175, this configuration may be reversed as desired to include a female connector having a slot with angled ribs and a male connector having a boss with angled slots.

The engagement between grooves 165 and ribs 175, which are both angled in operative rotational direction 144 in an axial direction 145 from outer axial end 150 of drive coupler 140 toward inner axial end 151 of drive coupler 140, tends to pull first and second component 160, 170 together when drive coupler 140 is driven in operative rotational direction 144. The engagement between the angled grooves 165 and ribs 175 tends to prevent first and second components 160, 170 from unwinding and separating from each other. If grooves 165 and ribs 175 were not angled and instead the grooves and ribs were formed in straight lines in the direction of rotational axis 141, first and second components 160, 170 could tend to unwind from each other if either the grooves or ribs were slightly misaligned or twisted counter to operative rotational direction 144 in an axial direction 145 from outer axial end 150 of drive coupler 140 toward inner axial end 151 of drive coupler 140. Further, in the embodiment illustrated, the mating of angled grooves 165 and ribs 175 eliminates the need to attach first and second components 160, 170 together with a fastener, e.g., a screw, pin, etc., which may increase cost and add manufacturing.

While it would be desirable from a cost and assembly perspective to construct drive coupler 140 from a single component, such a construction is limited by plastic molding constraints. To mold a single component drive coupler 140, relatively large wall thicknesses could be employed in order to achieve sufficient rigidity throughout the single component drive coupler 140, but large wall thicknesses are particularly susceptible to molding defects such as sinks and voids. Alternatively, smaller wall thicknesses could be employed to mold a single component drive coupler 140, but this approach substantially weakens drive coupler 140. In contrast, embodiments that include two components joined together by an angled press achieve sufficient rigidity with a decreased risk of molding defects since first and second components 160, 170 are individually molded. Another alternative is to construct drive coupler 140 as a single component composed of a stronger material, such as metal, but this approach significantly increases the cost of drive coupler 140 in comparison with a molded plastic construction.

Figure 10:
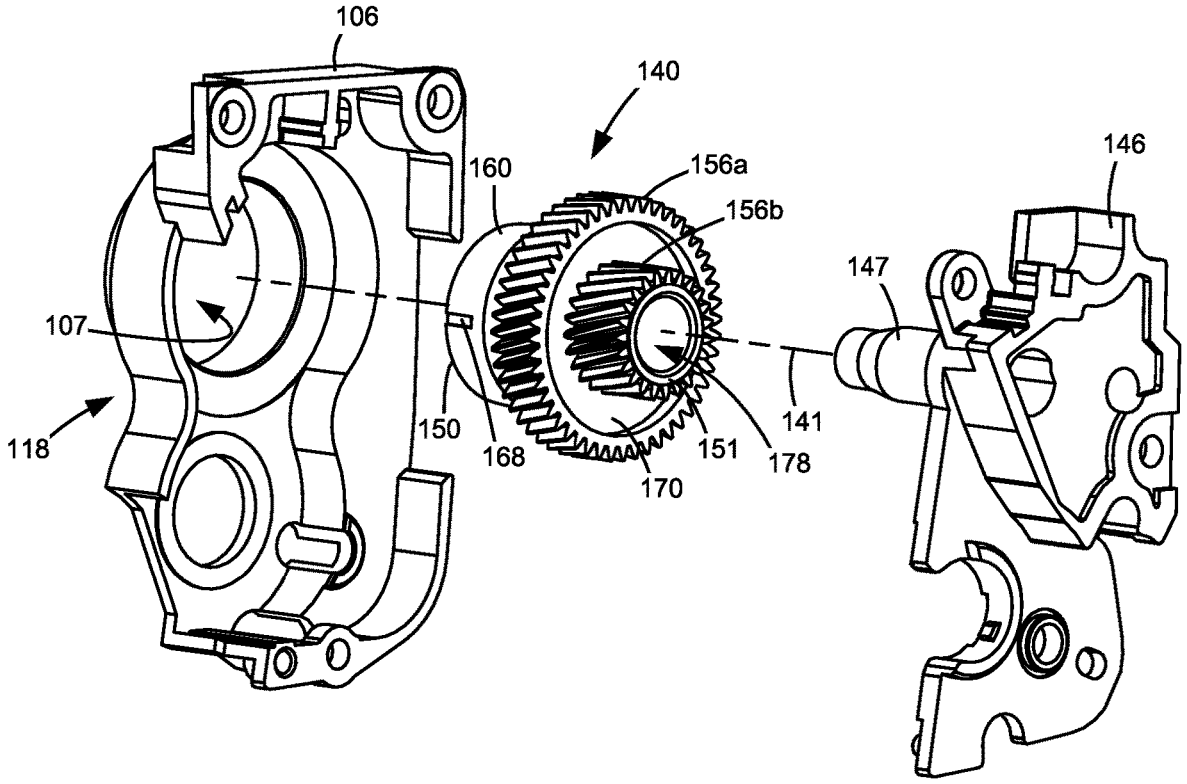
FIG. 10 is an exploded view of an end cap and a gear plate of the toner cartridge that position the drive coupler relative to the toner cartridge according to one example embodiment.

With reference to FIG. 10, in the embodiment illustrated, end 118 of housing 110 includes an end cap 106 that covers and protects various components at end 118 of housing 110 including a gear plate 146 and a gear train 180 discussed below. In this embodiment, inner axial end 151 of drive coupler 140 includes a slot 178 that extends axially into second component 170 from inner axial end 172 of second component 170 and that is centered about rotational axis 141 of drive coupler 140. Slot 178 receives a post 147 that extends axially outward from gear plate 146. Drive coupler 140 is free to rotate about post 147 with the engagement between slot 178 of drive coupler 140 and post 147 of gear plate 146 controlling the radial position of drive coupler 140. While the example embodiment illustrated includes a slot 178 positioned on drive coupler 140 and a corresponding post 147 positioned on gear plate 146, this configuration may be reversed as desired to include a post on drive coupler 140 and a corresponding slot on gear plate 146.

Outer axial end 150 of drive coupler 140 extends through a corresponding opening 107 in end cap 106 permitting drive coupler 140 to mate with the corresponding drive coupler in image forming device 22 when toner cartridge 100 is installed in image forming device 22. In the embodiment illustrated, opening 107 in end cap 106 has a smaller diameter than gear teeth 156*a* such that the portion of end cap 106 surrounding opening 107 retains second component 170 in the axial direction of drive coupler 140. In the embodiment illustrated, the engagement between grooves 165 of first component 160 and ribs 175 of second component 170 retains first component 160 in the axial direction of drive coupler 140.

Figure 11:
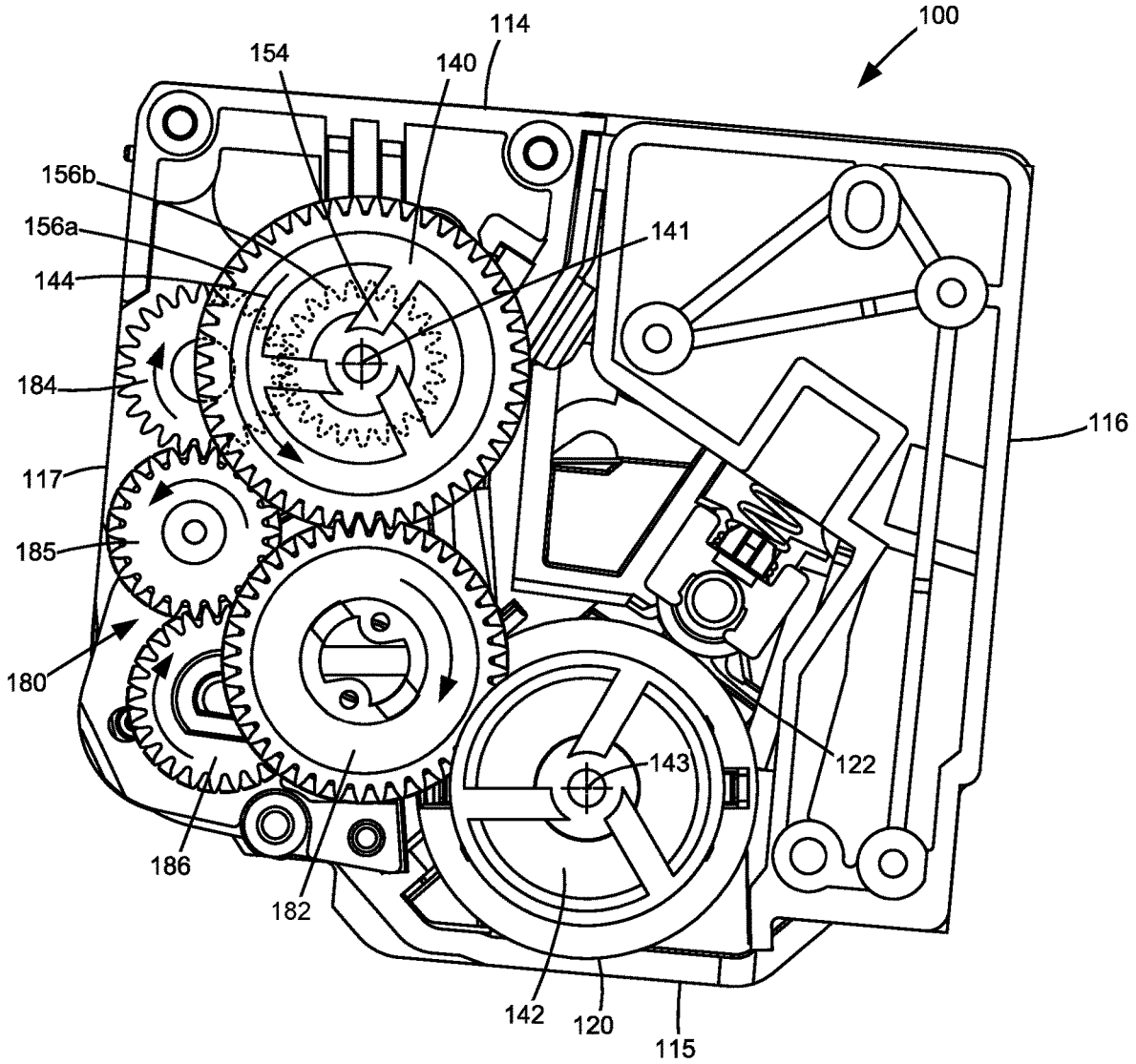
FIG. 11 is an elevation view of the first longitudinal end of the toner cartridge with an end cap omitted to show a gear train on the first longitudinal end of the toner cartridge according to one example embodiment.

FIG. 11 shows end 118 of housing 110 with end cap 106 (FIG. 3) omitted to show gear train 180 positioned on end 118 of housing 110 behind end cap 106 according to one example embodiment. In the example embodiment illustrated, gear train 180 transfers rotational motion received by drive coupler 140 to developer roll 128 and to toner adder roll 130 in order to rotate developer roll 128 and toner adder roll 130. In this embodiment, gear teeth 156*a* on second component 170 of drive coupler 140 mesh with a drive gear 182 that is coupled to a shaft of developer roll 128 in order to transfer rotational motion from drive coupler 140 to developer roll 128 when drive coupler 140 rotates in operative rotational direction 144. In this embodiment, gear teeth 156*b* on second component 170 of drive coupler 140 mesh with a first idler gear 184 that, in turn, meshes with a second idler gear 185 that meshes with a drive gear 186 that is coupled to a shaft of toner adder roll 130 in order to transfer rotational motion from drive coupler 140 to toner adder roll 130 when drive coupler 140 rotates in operative rotational direction 144.

Figure 12:
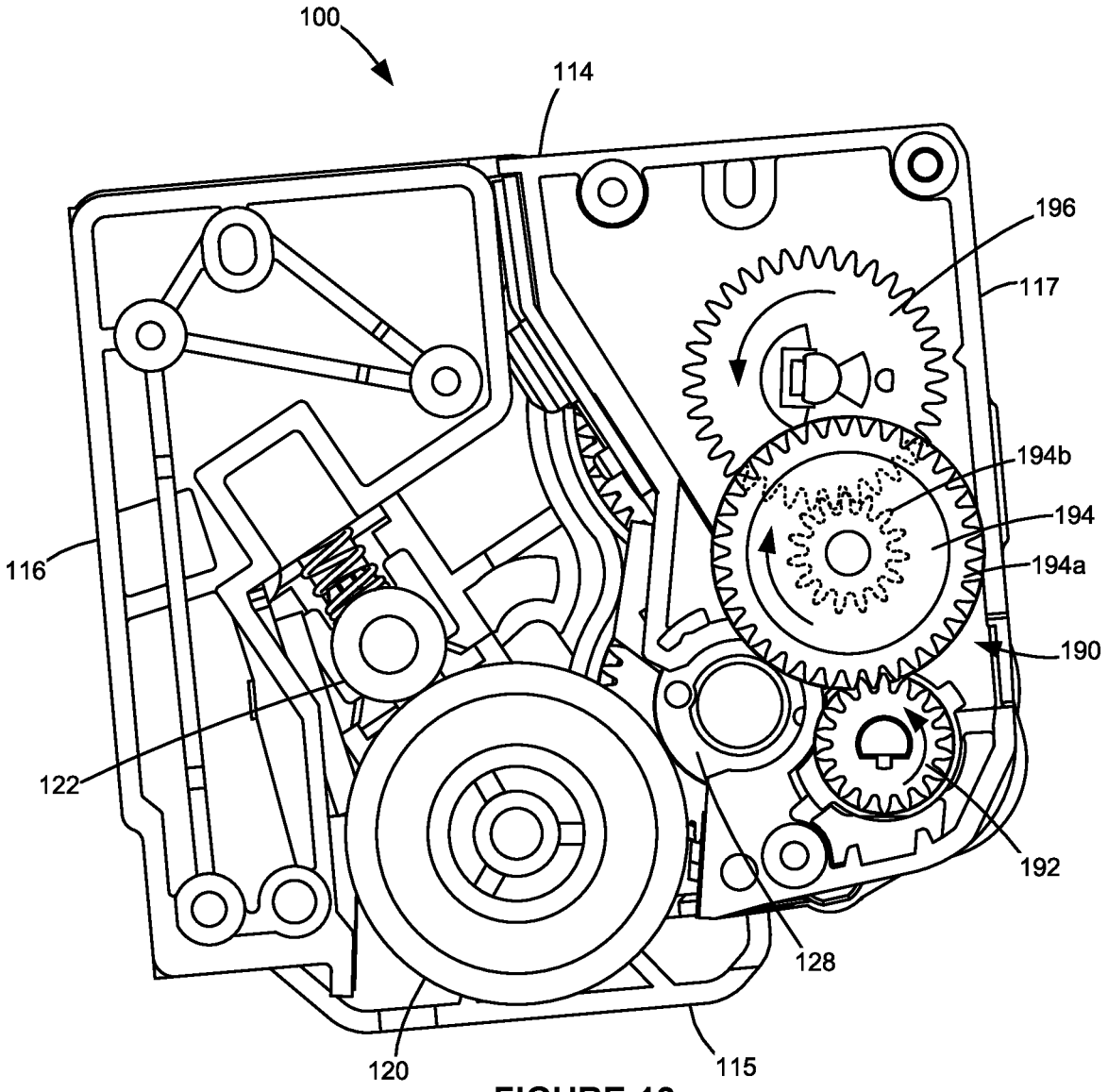
FIG. 12 is an elevation view of a second longitudinal end of the toner cartridge with an end cap omitted to show a gear train on the second longitudinal end of the toner cartridge according to one example embodiment.

FIG. 12 shows end 119 of housing 110 with an end cap 108 (FIG. 4) omitted to show a gear train 190 positioned on end 119 of housing 110 behind end cap 108 according to one example embodiment. In the example embodiment illustrated, gear train 190 transfers rotational motion from toner adder roll 130 to toner agitator 134 in order to rotate toner agitator 134. In this embodiment, a drive gear 192 that is coupled to the shaft of toner adder roll 130 meshes with gear teeth 194*a* of a compound idler gear 194. Gear teeth 194*b* of compound idler gear 194, in turn, mesh with a drive gear 196 that is coupled to a shaft of toner agitator 134 in order to transfer rotational motion received by toner adder roll 130 from drive coupler 140 to toner agitator 134 when drive coupler 140 rotates in operative rotational direction 144.

Figure 13:
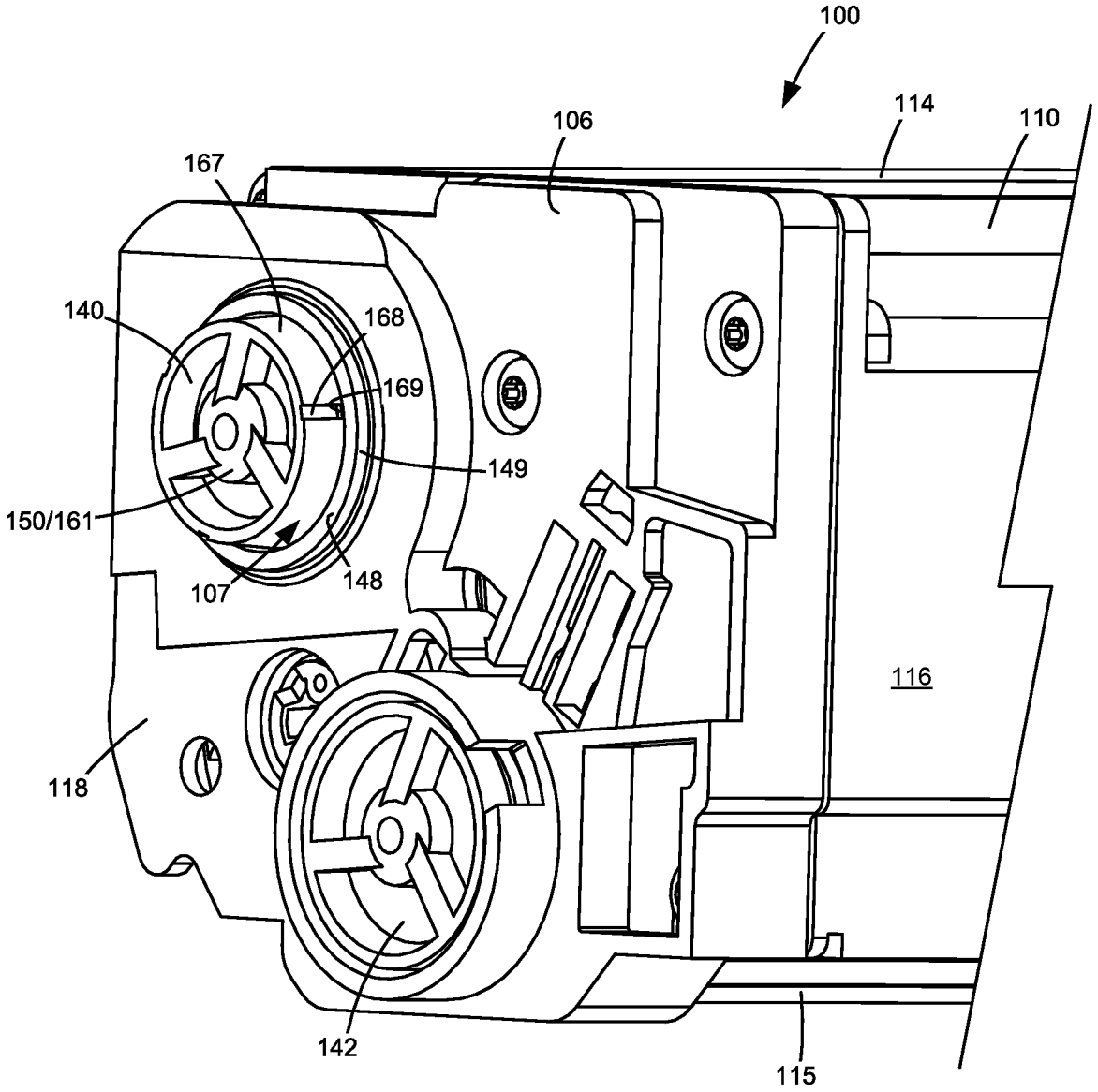
FIG. 13 is a perspective view of the first longitudinal end of the toner cartridge according to one example embodiment.

With reference to FIG. 13, in the example embodiment illustrated, a notch 168 is formed in an outer circumferential surface 167 of first component 160 that serves as a visual indicator during assembly of drive coupler 140 onto housing 110 to confirm that first component 160 is fully mated with second component 170. In this embodiment, notch 168 runs axially inward along outer circumferential surface 167 from outer axial end 161 of first component 160 to an endpoint 169 of notch 168. When drive coupler 140 is properly installed on toner cartridge 100, endpoint 169 of notch 168 is in line with an outer edge 148 of a collar 149 surrounding opening 107 in end cap 106 as illustrated in FIG. 13. Alignment between endpoint 169 of notch 168 and outer edge 148 of collar 149 indicates that first and second components 160, 170 are fully joined. If, on the other hand, endpoint 169 of notch 168 does not reach outer edge 148 of collar 149 when drive coupler 140 is installed on toner cartridge 100, the presence of a gap between endpoint 169 of notch 168 and outer edge 148 of collar 149 indicates that first and second components 160, 170 are not fully joined and that repair or reassembly is necessary. Some embodiments include more than one notch 168 spaced circumferentially around outer circumferential surface 167 to further aid in confirming that first and second components 160, 170 are fully joined during assembly.

Although the example embodiment illustrated includes a single replaceable unit in the form of toner cartridge 100 for each toner color, it will be appreciated that the replaceable unit(s) of the image forming device may employ any suitable configuration as desired. For example, in another embodiment, the main toner supply for the image forming device is provided in a first replaceable unit and the developer unit and photoconductor unit are provided in a second replaceable unit. Other configurations may be used as desired.

Further, it will be appreciated that the architecture and shape of toner cartridge 100 illustrated in FIGS. 2-5 is merely intended to serve as an example. Those skilled in the art understand that toner cartridges, and other toner containers, may take many different shapes and configurations.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. An interface drive coupler for a replaceable unit of an electrophotographic image forming device, comprising:

a first component;

a second component coaxial with the first component along a rotational axis of the interface drive coupler;

a force receiving portion positioned on the first component for receiving rotational force from a corresponding drive coupler in the image forming device; and a force transmitting portion positioned on the second component for transferring rotational force received by the force receiving portion to a rotatable component of the replaceable unit, wherein one of the first component and the second component includes a male connector and the other of the first component and the second component includes a female connector that matably receives the male connector, each of the male connector and the female connector includes a helical thread that extends circumferentially around the rotational axis of the interface drive coupler and that is angled in an operative rotational direction of the interface drive coupler in a direction from the force receiving portion toward the force transmitting portion along the rotational axis of the interface drive coupler, the helical thread of the male connector is engaged with the helical thread of the female connector joining the first component to the second component.

2. The interface drive coupler of claim 1, wherein the second component includes the male connector extending axially from an axial end of the second component, and the first component includes the female connector extending axially into an axial end of the first component.

3. The interface drive coupler of claim 1, wherein the first component and the second component of the interface drive coupler are joined by engagement between the helical threads of the male and female connectors without the use of a fastener joining the first component and the second component of the interface drive coupler.

4. The interface drive coupler of claim 1, wherein the force receiving portion includes a plurality of lugs that are positioned on an axial end of the first component and that are spaced circumferentially around the rotational axis of the drive coupler of the replaceable unit.

* * * * *